US007273152B1

(12) United States Patent
Kahn

(10) Patent No.: US 7,273,152 B1
(45) Date of Patent: Sep. 25, 2007

(54) DESK ORGANIZER

(76) Inventor: Ghulam M. Kahn, 2306 W. Howard Ave., Milwaukee, WI (US) 53221

( * ) Notice: Subject to any disclaimer, the term of this patent is extended or adjusted under 35 U.S.C. 154(b) by 498 days.

(21) Appl. No.: 10/911,563

(22) Filed: Aug. 5, 2004

Related U.S. Application Data

(60) Provisional application No. 60/492,987, filed on Aug. 7, 2003.

(51) Int. Cl.
*B42F 17/00* (2006.01)

(52) U.S. Cl. ..... 211/11; 211/126.13

(58) Field of Classification Search ..... 211/10, 211/11, 126.13, 126.15; D19/77, 68, 72, D19/75, 92, 99; 40/371; 206/371
See application file for complete search history.

(56) References Cited

U.S. PATENT DOCUMENTS 600,234 A 3/1898 Parr
3,149,724 A * 9/1964 Magers ..... 211/42
4,438,852 A 3/1984 Evans
4,753,346 A * 6/1988 Tsuji ..... 206/371
5,134,918 A * 8/1992 Chang ..... 84/600
5,302,014 A * 4/1994 Hobson ..... 312/249.12
5,377,850 A * 1/1995 Liaw ..... 211/163
D367,124 S * 2/1996 Sherman ..... D26/63
5,601,193 A 2/1997 Santoy
5,755,321 A * 5/1998 Wang ..... 206/214
5,765,697 A 6/1998 Soong
5,775,521 A 7/1998 Tisbo
6,092,672 A * 7/2000 Harris et al. ..... 211/11
6,102,216 A * 8/2000 Frank ..... 211/85.3
6,279,753 B1 * 8/2001 Swanson ..... 211/13.1
D506,784 S * 6/2005 Bodum ..... D19/72
6,968,957 B2 * 11/2005 Fynn ..... 211/11

* cited by examiner

*Primary Examiner*—Jennifer E. Novosad
(74) *Attorney, Agent, or Firm*—Patent & Trademark Services, Inc.; Joseph H. McGlynn

(57) ABSTRACT

The desk organizer includes three primary components: a base unit, a central tower and adjustable rack ends. The three primary components can accommodate various office supplies and equipment.

8 Claims, 3 Drawing Sheets

DESK ORGANIZER

Applicant claims priority of Provisional Ser. No. 60/492,987, filed Aug. 7, 2003.

BACKGROUND OF THE INVENTION

This invention relates generally to desk organizers, and more particularly to a desk organizer for use in an office setting.

DESCRIPTION OF THE PRIOR ART

Devices that are or can be used as office desk organizers are well known. For example, U.S. Pat. No. 4,770,829 to Goodyear discloses an office organizer having multiple compartments, trays, slots and cups for retaining or storing tools and materials.

U.S. Pat. No. 4,740,044 to Taylor discloses a vertically movable desk organizer mounted at the front end of a desk and having pivotal trays and bins. A compartmentalized storage center has rotatable, coverable trays, tiltable bins and other receptacles for office stationary.

U.S. Pat. No. 5,040,681 to Grusin discloses a desk organizer comprising a plurality of vertically stackable trays having partitions for storing articles of various sizes and shapes. Each tray has a hollow upright center post which is received within the center post of the tray positioned immediately above it.

U.S. Pat. No. 5,775,521 to Tisbo discloses an office organizer constructed of interlocking slat wall sections. Each slat is T-shaped to receive one or more hooks incorporated on the mounting side of organizational accessories. The accessories are removable placed on the slat wall as needed.

U.S. Pat. No. 5,765,697 to Soong discloses a desk organizer for CD's and compact disks.

U.S. Pat. No. 5,601,193 to Santoya discloses a desk organizer with a plurality of vertical holders and a note pad holder.

U.S. Pat. No. 600,234 to Parr discloses a desk organizer with an attached globe.

U.S. Pat. No. 4,438,852 to Evans discloses a desk organizer with a plurality of vertical partitions.

SUMMARY OF THE INVENTION

The primary object of the invention is to provide an office desk organizer. The desk organizer can help office workers keep their desks clean and organized.

The desk organizer of the present invention comprises three primary components: 1) a base unit, 2) a central tower and 3) adjustable rack ends. The three primary components can accommodate various supplies and equipment used in an office.

Another object is to provide a better and more compact desk organizer.

A further object of the invention is to provide a compact, independent organizer in a single unit that can accommodate all types of office supplies and equipment.

Still another object of the invention is to provide a desk organizer in which all office equipment can be used in place or can be detached and used away from the desk.

These and other objects and advantages of the present invention will become apparent from the following description, when taken in connection with the accompanying drawings.

DETAILED DESCRIPTION OF THE PREFERRED EMBODIMENT

Figure 1:
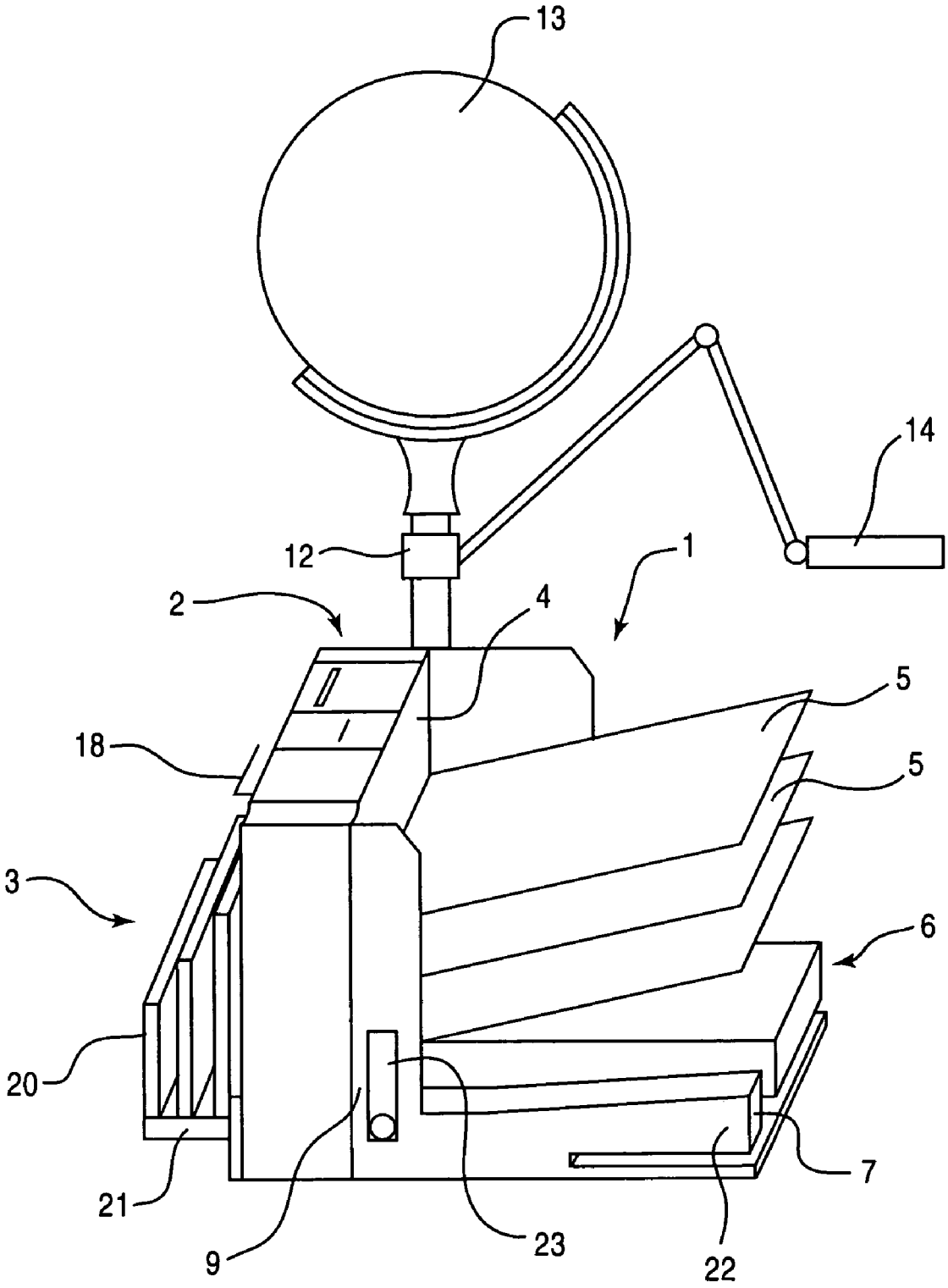
FIG. 1 is an isometric view of the desk organizer.
Figure 2:
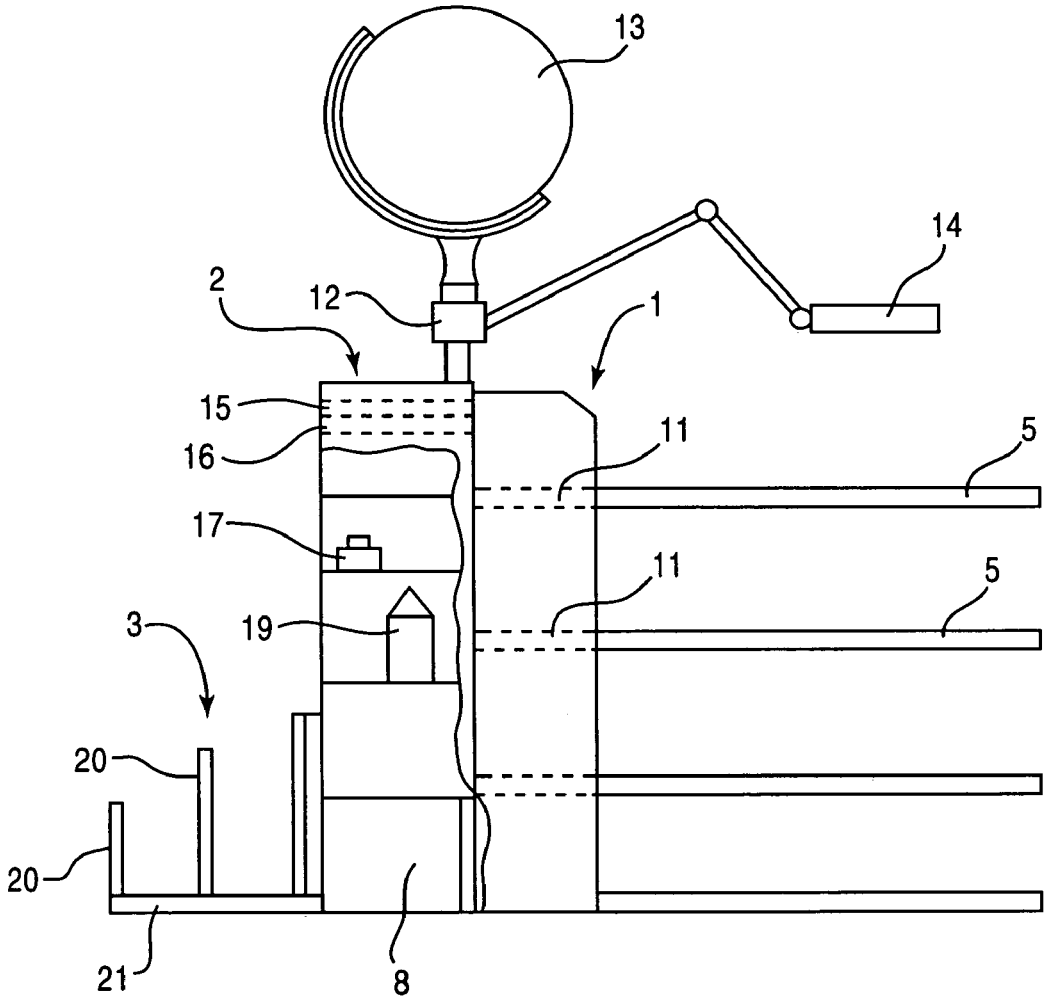
FIG. 2 is a side view of the desk organizer.

Referring now to the drawings in greater detail, particularly FIGS. 1 and 2, the inventive desk organizer comprises three primary components: a base unit 1, a central tower 2 and adjustable rack ends 3. The components are made of well-known construction materials such as metal, plastic, cardboard, wood, onyx and leather. The base unit 1 and the central tower 2 form a unitary body having a common wall 4 (FIG. 1). The base unit 1 can accommodate various supplies and equipment including detachable paper trays 5 (FIGS. 1 and 2), a conventional 2 or 3 hole punch 6 (FIGS. 1 and 3) a stapler 7 (FIGS. 1 and 3) and a partitioned drawer 8 (FIG. 2) for items such as different size paper clips and rubber bands. The base unit can include additional partitioned areas for accommodating such items as an anti-surge power outlet strip and a step down transformer box with multiple low voltage outlets and phone jacks.

Three paper trays 5 are shown in the drawing figures for illustration purposes only, however, more or fewer trays could be used without departing from the scope of the invention. The paper trays are attached to walls 4 and 10 of the base unit. As shown in FIG. 2, the trays 5 are attached by means of slots 11 in the side walls 9, although any conventional means can be used to attach the trays. Also, the slots can be angled as shown in FIG. 1 or horizontal as shown in FIG. 2.

The central tower 2 is the main organizational and supporting structure. As seen in FIG. 2, a side of the organizer has been removed so the internal structure of the main unit can be seen. The tower can accommodate various office supplies and equipment. FIG. 2 illustrates a swivel base 12 supporting a globe 13 and a lamp 14. The particular electrical connections employed would be chosen from conventional electrical connections depending on the needs of the user.

The central tower can also include various openings or holes 15, 16 and partitions to accommodate such items as tape 17 (FIG. 2), a letter opener 18 (FIG. 1), correction fluid 19 (FIG. 2), rulers, pens, pencils, business cards, envelopes, scissors, screw drivers, magnifying glass erasers and markers (not shown). The tower can also include space for electronic devices such as an electronic organizer, an alarm clock, calculator, radio, hand free telephone and a pencil sharpener. The size, number and locations of the partitions, holes and openings can be different from those illustrated dependent on the number and types of supplies and equipment to be accommodated.

The rack ends 3 are located on the back and to one side of the central tower 2 opposite the base unit 1. The rack ends can accommodate such items as books, note pads, files, DVD's, CD's and floppies. The rack ends include wall dividers 20 and a base 21. The width and height of the wall dividers and the width of the base 21 are adjustable dependent on the height and width of the items to be accommodated. The number of wall dividers can be more or less than the three shown. The base 21 may comprise a single piece or a number of telescoping pieces.

Figure 3:
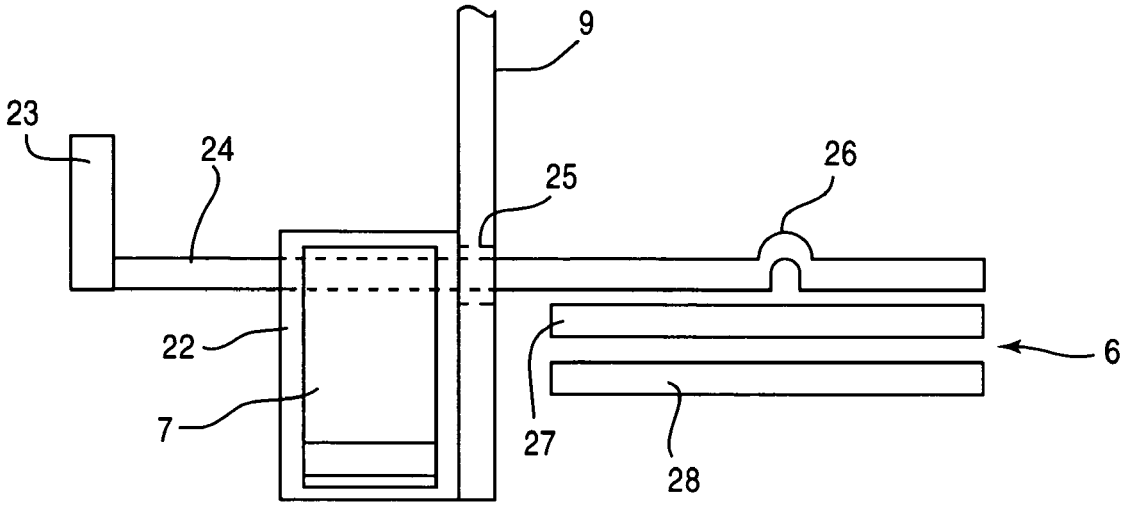
FIG. 3 is an end view of part of the base unit illustrating the presence of a stapler and a hole punch.

FIG. 3 illustrates the accommodation of the hole punch 6 and stapler 7 in the base unit 1. A housing 22 houses the stapler 7 and is connected to the side wall 9 by any conventional means. The stapler 7 can be removed from the housing 22, used, and then returned when the user is finished. A lever 23 for the hole punch 6 is positioned outside side wall 9. The lever 23 is journaled at 25 so the arm 24 will rotate when the lever 23 is rotated. As the arm 24 is rotated the projection 26 will rotate until it comes into contact with the top arm 27 of the punch. Further rotation will bring the top arm 27 down toward the bottom 28 of the punch and the paper will be punched in the conventional manner.

Name/designation plates can be attached to the desk organizer. One plate can be attached to the outside of the most distant rack end. An additional plate can be located on the back side, perhaps above a space for a power outlet strip.

Although the desk organizer according to the present invention has been described in the foregoing specification with considerable details, it is to be understood that modifications may be made to the invention which do not exceed the scope of the appended claims. Modified forms of the present invention done by others skilled in the art to which the invention pertains will be considered infringements of this invention when those modified forms fall within the claimed scope of this invention.

The invention claimed is:

1. A desk organizer comprising:

three basic components, said basic components comprising a base unit, a central tower and rack ends, said base unit having a back wall and at least one side wall, said at least one side wall having means for supporting pull out trays, and at least one pull out tray engaging said means for supporting pull out trays, and said central tower having a plurality of compartments for storing a variety of supplies, and said rack ends are attached to said back wall on a side opposite from said base unit, said rack ends having means for storing files, and wherein said pull out trays are at an angle to said back wall that is less than 90 degrees.

2. The desk organizer as claimed in claim 1, wherein said pull out trays are perpendicular to said back wall.

3. The desk organizer as claimed in claim 1, wherein a hole punch is positioned beneath said pull out trays.

4. The desk organizer as claimed in claim 1, wherein means is secured to said at least one side wall for supporting a globe.

5. The desk organizer as claimed in claim 4, wherein said means for supporting a globe also supports an adjustable light.

6. The desk organizer as claimed in claim 1, wherein a letter opener is secured to said back wall.

7. A desk organizer comprising:

three basic components, said basic components comprising a base unit, a central tower and rack ends, said base unit having a back wall and at least one side wall, said at least one side wall having means for supporting pull out trays, and said central tower having a plurality of compartments for storing a variety of supplies, and said rack ends are attached to said back wall on a side opposite from said base unit, and said rack ends having means for storing files, and wherein a hole punch is incorporated beneath said pull out trays, and wherein means is positioned into said at least one side wall for operating said hole punch.

8. The desk organizer as claimed in claim 1, wherein said means for operating said hole punch comprises a lever, said lever is attached to an arm, said arm journaled in said at least one side wall, said arm having a protrusion extending above a top of said hole punch, whereby when said arm is rotated said protrusion engages and moves said top of said hole punch toward a bottom of said hole punch.

* * * * *

UNITED STATES PATENT AND TRADEMARK OFFICE

CERTIFICATE OF CORRECTION

PATENT NO. : 7,273,152 B1
APPLICATION NO. : 10/911563
DATED : September 25, 2007
INVENTOR(S) : Ghulam M. Khan It is certified that error appears in the above-identified patent and that said Letters Patent is hereby corrected as shown below:

On the Title Page, item [75]:

Change the inventors name from "Ghulam M. Kahn" to --Ghulam M. Khan--.

Change the inventor's address from: "2306 W. Howard Ave. Milwaukee, WI 53221" to --3226 W. Bottsford Ave, Greensfield, WI 53221--.

Signed and Sealed this

Twelfth Day of February, 2008

JON W. DUDAS
*Director of the United States Patent and Trademark Office*